US007449086B2

(12) United States Patent
Gray et al.

(10) Patent No.: US 7,449,086 B2
(45) Date of Patent: Nov. 11, 2008

(54) USE OF SYNTHETIC METAL SILICATES FOR DECREASING THE DEPOSITION OF CONTAMINANTS DURING A PAPERMAKING PROCESS

(75) Inventors: Ross T. Gray, Plainfield, IL (US); Laura M. Sherman, Naperville, IL (US); Bruce A. Keiser, Naperville, IL (US)

(73) Assignee: Nalco Company, Naperville, IL (US)

( * ) Notice: Subject to any disclaimer, the term of this patent is extended or adjusted under 35 U.S.C. 154(b) by 441 days.

(21) Appl. No.: 11/231,661

(22) Filed: Sep. 21, 2005

(65) Prior Publication Data

US 2007/0062662 A1 Mar. 22, 2007

(51) Int. Cl.
*D21H 11/00* (2006.01)

(52) U.S. Cl. ..... 162/181.6; 162/199

(58) Field of Classification Search ..... 162/181.6, 162/199

See application file for complete search history.

(56) References Cited

U.S. PATENT DOCUMENTS

| | | | |
|---|---|---|---|
| 4,964,955 | A | 10/1990 | Lamar et al. |
| 5,037,508 | A | 8/1991 | Hyder et al. |
| 5,130,028 | A | 7/1992 | Cody et al. |
| 5,221,436 | A | 6/1993 | Rogan et al. |
| 5,534,057 | A | 7/1996 | Harrison et al. |
| 5,540,814 | A | 7/1996 | Curtis et al. |
| 5,798,023 | A | 8/1998 | Pruszynski et al. |
| 2003/0079848 | A1 | 5/2003 | Ahlgren et al. |
| 2005/0173088 | A1 | 8/2005 | Grimsley et al. |

FOREIGN PATENT DOCUMENTS

| | | | |
|---|---|---|---|
| EP | 0740014 | A1 | 3/1996 |
| GB | 2224019 | A | 6/1989 |
| GB | 2250510 | B | 6/1989 |
| WO | WO 96/35764 | | 5/1996 |

OTHER PUBLICATIONS

Boardman, D., "The use of organophilic mineral particulates in the control of anionic trash like pitch", 1996 TAPPI Papermakers Conference, Philadelphia, PA (1996), pp. 533-538.

Carter, D. and Hyder, J., "Treated Kaolin Combines Effective Pitch Control with Handling Ease", Pulp & Paper, 67(11), (1993) pp. 87-90.

*Primary Examiner*—Mark Halpern
(74) *Attorney, Agent, or Firm*—Peter A. DiMattia

(57) ABSTRACT

A method for decreasing the amount of contaminants in a papermaking a process is disclosed. The method involves adding an effective amount of SMS to said papermaking process.

9 Claims, No Drawings

USE OF SYNTHETIC METAL SILICATES FOR DECREASING THE DEPOSITION OF CONTAMINANTS DURING A PAPERMAKING PROCESS

FIELD OF INVENTION

This disclosure relates to a method for decreasing the deposition of contaminants in a papermaking process through the addition of a synthetic metal silicate.

BACKGROUND

The deposition of contaminants on process equipment, screens, and containment vessels in papermaking significantly reduces process efficiency and paper quality. Deposits on machine wires, felts, foils, headbox surfaces, screens, and instruments require costly downtime for cleaning to avoid the problems associated with poor process control, reduced throughput, and substandard sheet properties. These contaminants are generically referred to in the paper industry as either "pitch" or "stickies".

Pitch deposits generally originate from natural resins (fatty acids, rosin acids, sterols, etc), resin salts, coating binders, or sizing agents found in the pulp (Journal of Pulp and Paper Science, 22:11,431-439, 1996). Pitch may also contain inorganic materials such as talc, calcium carbonate, or titanium dioxide. Stickies generally refers to the hydrophobic substances used in the manufacture of paper such as pressure sensitive or contact adhesives such as styrene butadiene rubber, hot melt adhesives such as ethylene vinyl acetate and thermoplastics inks (styrene acrylate, polyvinyl butyral) that can form deposits when reintroduced in recycled fiber systems. Other common hydrophobic contaminants found in recycle applications include wax, which originates primarily from wax-coated old corrugated containers, and polyisoprene.

Recycled fiber refers to secondary fibers which are repulped to provide the papermaking furnish with raw material for the production of new papers. The secondary fibers may be either pre-consumer or post-consumer paper material that is suitable for use in the production of paper products. Sources of secondary fiber may include old newspaper (ONP), old corrugated containers (OCC), mixed office waste (MOW), computer printout (CPO), ledger, etc. These once-processed papers contain various types of adhesives (pressure sensitive, hot melts, etc.), inks, and coating binders. Coating binders can include the so-called 'white pitch' associated with the repulping of polyvinyl acetate and styrene butadiene coated broke.

Pitch and stickies are hydrophobic in nature and thus quite unstable as colloids in aqueous papermaking environments, thereby facilitating their deposition. The major problems arising from deposition are as follows: (1) reduced throughput due to plugging of forming fabrics and press felts (2) sheet holes or paper breaks due to large deposits breaking loose from the equipment, and (3) reduced sheet quality due to contaminants incorporated in the final sheet.

A current protocol for dealing with contaminant deposition in the papermaking process involves the addition of talc and saponite clay. A more improved methodology is needed.

SUMMARY OF THE INVENTION

The present invention provides a method for decreasing the deposition of contaminants during a papermaking process comprising adding an effective amount of SMS.

The present invention also provides a method for decreasing the deposition of contaminants during a papermaking process that produces paper products from mechanical pulp, deinked pulp, or combination thereof comprising the addition of an effective amount of SMS to said papermaking process.

DETAILED DESCRIPTION OF THE INVENTION

"SMS" means a synthetic metal silicate of the following formula: $(Mg_{3-x}Li_x)Si_4Na_{0.33}[F_y(OH)_{2-y}]_2O_{10}$, wherein: x is 0 to 3.0; and y is 0.01 to 2.0.

The synthetic metal silicate of the present invention can be made by combining simple silicates and lithium, magnesium, and fluoride salts in the presence of mineralizing agents and subjecting the resulting mixture to hydrothermal conditions. As an example, one might combine a silica sol gel with magnesium hydroxide and lithium fluoride in an aqueous solution and under reflux for two days to yield a synthetic metal silicate of the current invention. (See Industrial & Chemical Engineering Chemistry Research (1992), 31(7), 1654, which is herein incorporated by reference). One can also obtain SMS directly from Nalco Company, Naperville, Ill. 60563.

"Papermaking process" means a method of making paper products from pulp comprising forming an aqueous cellulosic papermaking furnish, draining the furnish to form a sheet and drying the sheet. The steps of forming the papermaking furnish, draining and drying may be carried out in any conventional manner generally known to those skilled in the art.

As stated above, the present invention provides a method for decreasing the deposition of contaminants during a papermaking process that comprises the addition of SMS. The SMS maybe added to the papermaking process as a solid or as a dispersion. In one embodiment, the synthetic metal silicate is added a slurry that is located in said papermaking process. The slurry may be a papermaking processes pulp thick stock.

In another embodiment, the contaminants found in the papermaking process are hydrophobic contaminants. In a further embodiment, the hydrophobic contaminants are selected from the group consisting of: natural wood pitch, stickies, and white pitch from the repulping of coated broke.

In another embodiment, the effective amount of synthetic metal silicate added to said papermaking process is selected from the group consisting of: from about 0.5 lb to about 20 lbs of synthetic metal silicate per ton of solids in said slurry; from about 2 lbs to about 15 lbs of synthetic metal silicate per ton of solids in said slurry; and from about 4 lbs to about 10 lbs of synthetic metal silicate per ton of solids in said slurry.

The present invention will be further described in the following example. The example is not intended to limit the invention prescribed by the appended claims.

EXAMPLE 1

One liter of mill white water was poured into a deposition vessel and begin mixing using an overhead propeller mixer at 500 rpm. The white water was obtained from the clear leg of the paper machine saveall at a mill producing groundwood containing publication grades.

After adding and mixing the white water in the deposition vessel, a solution of SMS was added to the deposition vessel at a desired treatment level. One vessel was a control group that had 40 mL of deionized water. Another vessel contained 40 mL of a 0.25 wt % SMS dispersion. Another vessel contained 40 mL of a 0.25 wt % Laponite® RD dispersion. Laponite® RD is a synthetic hydrous sodium lithium magnesium silicate which is identified by CAS No. 533320-86-8 and has a typical chemical composition based on weight percent of: $SiO_2$ 59.5; MgO 27.5; $Li_2O$ 0.8; and $Na_2O$ 2.8. Laponite® RD is available from Rockwood Specialties, Ltd, Widness, Cheshire, United Kingdom.

The pitch deposition equipment used was a quartz crystal microbalance ("QCM") that is available from Nalco Company, Naperville, Ill. 60614. The deposition vessel consisted of a plexiglass cylinder with a height of 15 cm and an inside diameter of 10.8 cm. A threaded hole with a diameter of 4.8 cm was located approximately half way up the sidewall. The QCM was inserted into this threaded hole and it was connected to a computer for data acquisition. The QCM surface was circular and had an area of 1.35 $cm^2$.

The data collection frequency used was once every ten seconds. At 10 seconds, 50 mL of synthetic pitch solution (0.4 g pitch) was added. The pitch was a mixture of 50 wt % abietic acid, 10 wt % oleic acid, 10 wt % palmitic acid, 10 wt % corn oil, 5 wt % methyl stearate, 5 wt % β-sitosterol, 5 wt % cholesteryl caproate, and 5 wt % oleyl. This pitch was dissolved at a concentration of 1% by weight in isopropanol.

At 20 seconds, 8 mL of 0.5 M calcium chloride dihydrate solution was added to promote deposition. Mixing and collecting data was continued for 13 to 15 minutes. The pH of the solution was measured at the end of the 15 minute period.

The cumulative amount of deposition on the QCM was averaged for the time period of 880, 890, and 900 seconds and the results are illustrated in the following table.

| | Treatment | | Pitch | Deposition after 15 minutes | |
|---|---|---|---|---|---|
| Test | Name | Amount (g) | Amount (g) | (μg/$cm^2$) | pH |
| 1 | Laponite RD | 0.1 | 0.4 | 14.4 | 6.6 |
| 2 | Control | 0.0 | 0.4 | 23.7 | 6.6 |
| 3 | SMS | 0.1 | 0.4 | 8.9 | 6.6 |

What is claimed is:

1. A method for decreasing the deposition of contaminants during a papermaking process comprising adding an effective amount of synthetic metal silicate to said papermaking process, wherein said synthetic metal silicate has the following formula: $(Mg_{3-x}Li_x)\ Si_4\ Na_{0.33}\ [F_x(OH)_{2-y}]_2O_{10}$. wherein: x is 0 to 3.0; and y is 0.01 to 2.0.

2. The method of claim 1, wherein said synthetic metal silicate is added to a slurry that is located in said papermaking process.

3. The method of claim 2, wherein said slurry is a pulp thick stock.

4. The method of claim 2, wherein said contaminants are hydrophobic contaminants.

5. The method of claim 4, wherein said hydrophobic contaminants are selected from the group consisting of: natural wood pitch, stickies, and white pitch from the repulping of coated broke.

6. The method of claim 2, wherein said effective amount of said synthetic metal silicate is from about 0.5 lb to about 20 lbs of synthetic metal silicate per ton of solids in said slurry in said papermaking process.

7. The method of claim 2, wherein said effective amount of said synthetic metal silicate is from about 2 lbs to about 15 lbs of synthetic metal silicate per ton of solids in said slurry in said papermaking process.

8. The method of claim 2, wherein said effective amount of said synthetic metal silicate is from about 4 lbs to about 10 lbs of synthetic metal silicate per ton of solids in said slurry in said papermaking process.

9. A method for decreasing the deposition of contaminants during a papermaking process that produces paper products from a combination of mechanical pulp, deinked pulp, or a combination thereof comprising the addition of an effective amount of synthetic metal silicate to said papermaking process, wherein said synthetic metal silicate has the following formula: $(Mg_{3-x}Li_x)\ Si_4\ Na_{0.33}[F_y(OH)_{2-y}]_2O_{10}$wherein: x is 0 to 3.0 and y is 0.01 to 2.0.

* * * * *